US008882515B2

(12) United States Patent
Lv et al.

(10) Patent No.: US 8,882,515 B2
(45) Date of Patent: Nov. 11, 2014

(54) PLUG CONNECTOR AND CONNECTOR ASSEMBLY

(75) Inventors: Biaobing Lv, Shanghai (CN); Huibin Li, Shanghai (CN); Wei Yao, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 4 days.

(21) Appl. No.: 13/458,331

(22) Filed: Apr. 27, 2012

(65) Prior Publication Data

US 2012/0276777 A1 Nov. 1, 2012

(30) Foreign Application Priority Data

Apr. 29, 2011 (CN) ..... 2011 2 0138926 U

(51) Int. Cl.
*H01R 12/00* (2006.01)
*H01R 24/62* (2011.01)
*H01R 13/6581* (2011.01)

(52) U.S. Cl.
CPC ..... *H01R 24/62* (2013.01); *H01R 13/6581* (2013.01)
USPC ..... 439/79; 439/607.35

(58) Field of Classification Search
USPC ..... 439/660, 607.35, 607.36, 79
See application file for complete search history.

(56) References Cited

U.S. PATENT DOCUMENTS 4,201,432 A * 5/1980 Chalmers ..... 439/82
6,270,379 B1 * 8/2001 Huang et al. ..... 439/660
7,128,617 B2 * 10/2006 Wang et al. ..... 439/660
7,318,752 B2 * 1/2008 Fujimoto et al. ..... 439/660
7,371,116 B2 * 5/2008 Chiang ..... 439/607.34
7,422,488 B1 * 9/2008 Wu ..... 439/676
7,427,214 B2 * 9/2008 Liao et al. ..... 439/607.01
7,445,469 B2 * 11/2008 Wu ..... 439/79
7,485,008 B1 * 2/2009 Yi et al. ..... 439/660
7,534,141 B1 * 5/2009 Wu ..... 439/607.01
7,534,143 B1 * 5/2009 Tsao et al. ..... 439/607.41
7,563,140 B1 * 7/2009 Wan et al. ..... 439/660
7,614,920 B1 * 11/2009 Yi ..... 439/682
7,618,293 B2 * 11/2009 Wu ..... 439/660
7,625,243 B2 * 12/2009 Chen et al. ..... 439/660
7,682,163 B2 * 3/2010 Hou et al. ..... 439/79
7,695,318 B1 * 4/2010 Wang et al. ..... 439/607.01
7,713,093 B2 * 5/2010 Kim ..... 439/660
7,717,733 B1 * 5/2010 Yi et al. ..... 439/452
7,736,184 B1 * 6/2010 Wan et al. ..... 439/607.11
7,744,382 B2 * 6/2010 Zheng et al. ..... 439/79
7,806,704 B2 * 10/2010 Miyoshi et al. ..... 439/108
7,833,065 B2 * 11/2010 Lin et al. ..... 439/639

(Continued)

*Primary Examiner* — Ross Gushi
(74) *Attorney, Agent, or Firm* — Barley Snyder

(57) ABSTRACT

A plug includes an insulation body, a plurality of first contacts, and a plurality of second contacts. The plurality of first contacts are assembled in the insulation body and include a plurality of first contact portions disposed at a first side of the insulation body and a plurality of first legs disposed along a second side of the insulation body. The plurality of first contact portions are arranged in a first row along the first side. The plurality of second contacts are assembled in the insulation body and include a plurality of second contact portions disposed at the first side of the insulation body and a plurality of second legs disposed along the second side. The plurality of second contact portions are arranged along a second row along the surface side of the first side such that the first row is spaced from the second row by a predetermined distance.

10 Claims, 6 Drawing Sheets

(56) References Cited

U.S. PATENT DOCUMENTS 7,837,510 B1 * 11/2010 Hung et al. ..... 439/660
7,845,982 B1 * 12/2010 Wang ..... 439/607.25
7,850,465 B1 * 12/2010 Wan et al. ..... 439/79
7,909,653 B1 * 3/2011 Wan et al. ..... 439/660
7,922,525 B2 * 4/2011 Lee ..... 439/541.5
7,938,659 B1 * 5/2011 Zhu et al. ..... 439/218
7,942,704 B2 * 5/2011 Ko et al. ..... 439/660
7,946,893 B2 * 5/2011 Chen et al. ..... 439/660
7,972,151 B2 * 7/2011 He et al. ..... 439/108
7,988,495 B2 * 8/2011 Chung ..... 439/660
7,988,499 B2 * 8/2011 Lin et al. ..... 439/701
8,002,589 B1 * 8/2011 Yu et al. ..... 439/660
8,033,841 B2 * 10/2011 He ..... 439/108
8,052,431 B1 * 11/2011 He et al. ..... 439/78
8,052,477 B1 * 11/2011 Ko ..... 439/660
8,070,519 B2 * 12/2011 Lin et al. ..... 439/620.24
8,079,854 B2 * 12/2011 He et al. ..... 439/108
8,079,879 B2 * 12/2011 Chiang ..... 439/660
8,109,795 B2 * 2/2012 Lin et al. ..... 439/660
8,123,558 B2 * 2/2012 Su et al. ..... 439/607.01
8,133,078 B2 * 3/2012 Lin et al. ..... 439/660
8,133,079 B2 * 3/2012 He ..... 439/660
8,152,568 B2 * 4/2012 Wu ..... 439/660
8,152,569 B2 * 4/2012 Chen et al. ..... 439/660
8,172,585 B2 * 5/2012 Chiu et al. ..... 439/108
8,198,563 B2 * 6/2012 Tsai ..... 218/140
8,206,174 B2 * 6/2012 Ko ..... 439/489
8,215,996 B2 * 7/2012 Su et al. ..... 439/660
8,231,410 B2 * 7/2012 Tung et al. ..... 439/607.01
8,262,414 B1 * 9/2012 Li et al. ..... 439/607.35
8,267,703 B2 * 9/2012 Yao et al. ..... 439/79
8,277,253 B2 * 10/2012 Lee et al. ..... 439/607.32
8,292,671 B2 * 10/2012 Chung ..... 439/660
8,303,319 B2 * 11/2012 Yu et al. ..... 439/152
8,303,329 B2 * 11/2012 Wu ..... 439/395
8,308,376 B2 * 11/2012 Liao et al. ..... 385/92
8,376,783 B2 * 2/2013 Kondo et al. ..... 439/660
8,382,510 B2 * 2/2013 Lee et al. ..... 439/490
8,382,519 B2 * 2/2013 Lin et al. ..... 439/607.01
8,398,416 B2 * 3/2013 Tseng ..... 439/188
8,398,427 B2 * 3/2013 Wu ..... 439/497
8,408,940 B2 * 4/2013 Chang ..... 439/607.01
8,419,480 B2 * 4/2013 Yu et al. ..... 439/660
8,439,691 B1 * 5/2013 Lan et al. ..... 439/79
8,460,036 B1 * 6/2013 Chen ..... 439/660
8,465,299 B2 * 6/2013 Ho ..... 439/79
8,480,435 B2 * 7/2013 Hsiao et al. ..... 439/660
8,485,851 B2 * 7/2013 Kondo et al. ..... 439/660
2006/0025015 A1 * 2/2006 Hu et al. ..... 439/607
2007/0049119 A1 * 3/2007 Fujimoto et al. ..... 439/610
2007/0173121 A1 * 7/2007 Chiang ..... 439/609
2007/0218762 A1 * 9/2007 Liao et al. ..... 439/607
2009/0042450 A1 * 2/2009 Zheng et al. ..... 439/660
2009/0111330 A1 * 4/2009 Lin et al. ..... 439/638
2009/0117784 A1 * 5/2009 Wu ..... 439/660
2009/0117785 A1 * 5/2009 Wu ..... 439/668
2009/0130906 A1 * 5/2009 Tsao et al. ..... 439/626
2009/0258539 A1 * 10/2009 Zheng et al. ..... 439/607.41
2010/0015831 A1 * 1/2010 Miyoshi ..... 439/218
2010/0015855 A1 * 1/2010 Chiang ..... 439/660
2010/0136848 A1 * 6/2010 Lin et al. ..... 439/701
2010/0159745 A1 * 6/2010 Wan et al. ..... 439/607.11
2010/0159751 A1 * 6/2010 Chiu et al. ..... 439/660
2010/0173529 A1 * 7/2010 He et al. ..... 439/660
2010/0173530 A1 * 7/2010 Tsai ..... 439/660
2010/0216340 A1 * 8/2010 Lin et al. ..... 439/607.01
2010/0248545 A1 * 9/2010 Lin et al. ..... 439/607.04
2010/0255702 A1 * 10/2010 Lin et al. ..... 439/218
2010/0322570 A1 * 12/2010 Zheng et al. ..... 385/93
2011/0070778 A1 * 3/2011 Wan et al. ..... 439/660
2011/0124234 A1 * 5/2011 Chung ..... 439/660
2011/0195601 A1 * 8/2011 Chen et al. ..... 439/607.01
2011/0269322 A1 * 11/2011 He et al. ..... 439/78
2011/0269341 A1 * 11/2011 He et al. ..... 439/607.01
2011/0281446 A1 * 11/2011 Yu et al. ..... 439/92
2012/0009811 A1 * 1/2012 He et al. ..... 439/345
2012/0040540 A1 * 2/2012 Lee et al. ..... 439/65
2012/0052739 A1 * 3/2012 Wang et al. ..... 439/660
2012/0077370 A1 * 3/2012 Lee et al. ..... 439/488
2012/0077390 A1 * 3/2012 Tsai ..... 439/660
2012/0196483 A1 * 8/2012 Kuster ..... 439/626
2012/0252245 A1 * 10/2012 Chang ..... 439/218
2012/0252270 A1 * 10/2012 Lee et al. ..... 439/607.01
2012/0252279 A1 * 10/2012 Lee et al. ..... 439/660
2012/0276777 A1 * 11/2012 Lv et al. ..... 439/607.01
2013/0040499 A1 * 2/2013 Wang et al. ..... 439/660
2013/0065448 A1 * 3/2013 Chiu et al. ..... 439/660
2013/0171884 A1 * 7/2013 Ho ..... 439/660

* cited by examiner

PLUG CONNECTOR AND CONNECTOR ASSEMBLY

CROSS-REFERENCE TO RELATED APPLICATION

This application claims priority under 35 U.S.C. §119 to Chinese Patent Application No. 201120138926.9 filed on Apr. 29, 2011.

FIELD OF THE INVENTION

The present invention relates to a connector assembly and, more particularly, to a plug and a receptacle mated with the plug.

BACKGROUND

A connector is known that is adapted to transmit only one respective kind of signals, for example, the conventional Micro USB (Universal Serial Bus) connector is adapted to transmit only Micro USB signals, and the conventional MHL (Mobile High-Definition Link) connector is adapted to transmit only MHL signals.

Accordingly, in the prior art, when it needs to simultaneously transmit two different kinds of signals, two respective kinds of connectors for transmitting the two different kinds of signals have to be used in an electronic apparatus, such as a notebook Personal Computer, a mobile communication device, etc. Such two kinds of connectors increase the size and cost of the electronic apparatus, and it is very inconvenient for a user to use the electronic apparatus.

SUMMARY

The invention has been made to overcome or alleviate at least one aspect of the above mentioned disadvantages. Accordingly, it is desirable to provide a compact connector that is able to simultaneously transmit two different kinds of signals without increasing the size and cost of it.

The connector includes a plug having an insulation body, a plurality of first contacts, and a plurality of second contacts. The plurality of first contacts are assembled in the insulation body and include a plurality of first contact portions disposed at a first side of the insulation body and a plurality of first legs disposed along a second side of the insulation body. The plurality of first contact portions are arranged in a first row along the first side. The plurality of second contacts are assembled in the insulation body and include a plurality of second contact portions disposed at the first side of the insulation body and a plurality of second legs disposed along the second side. The plurality of second contact portions are arranged along a second row along the surface side of the first side such that the first row is spaced from the second row by a predetermined distance.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENT(S)

Figure 1:
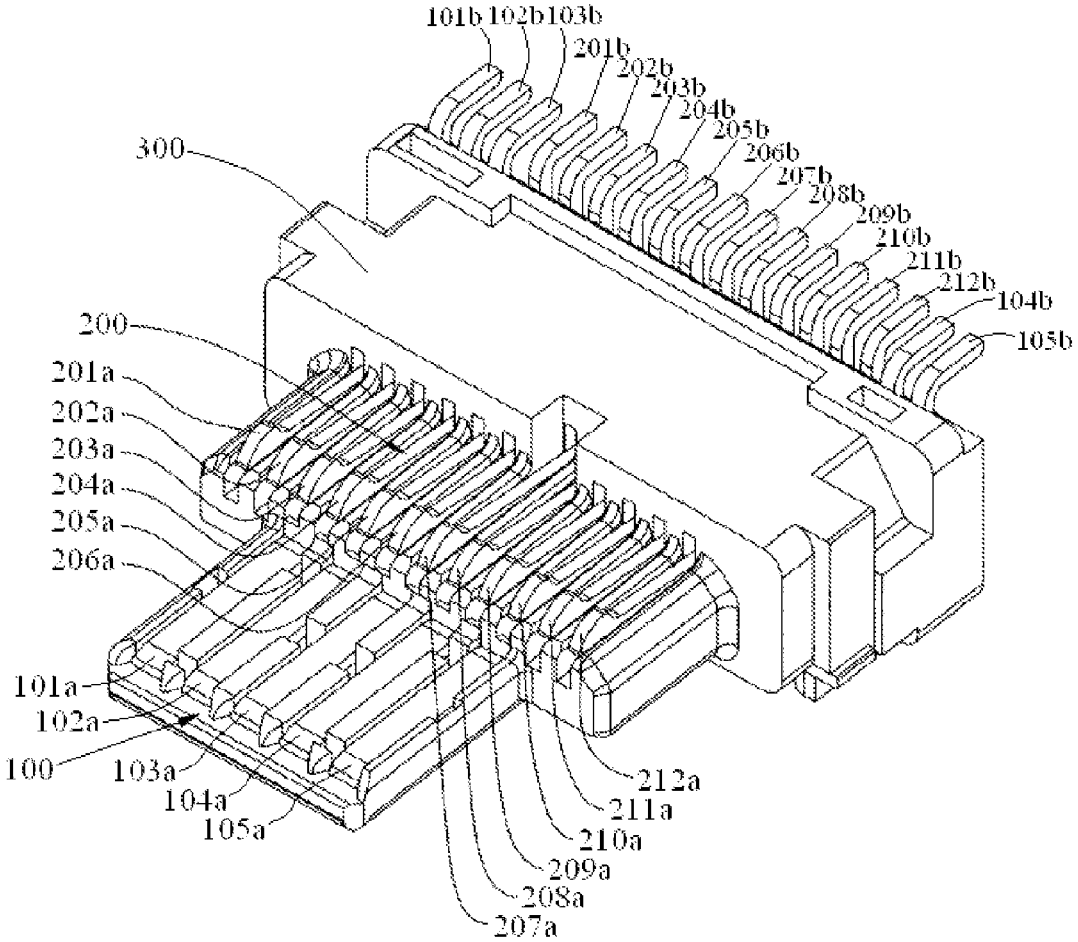
FIG. 1 is a perspective view showing an insulation body of a receptacle according to the invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
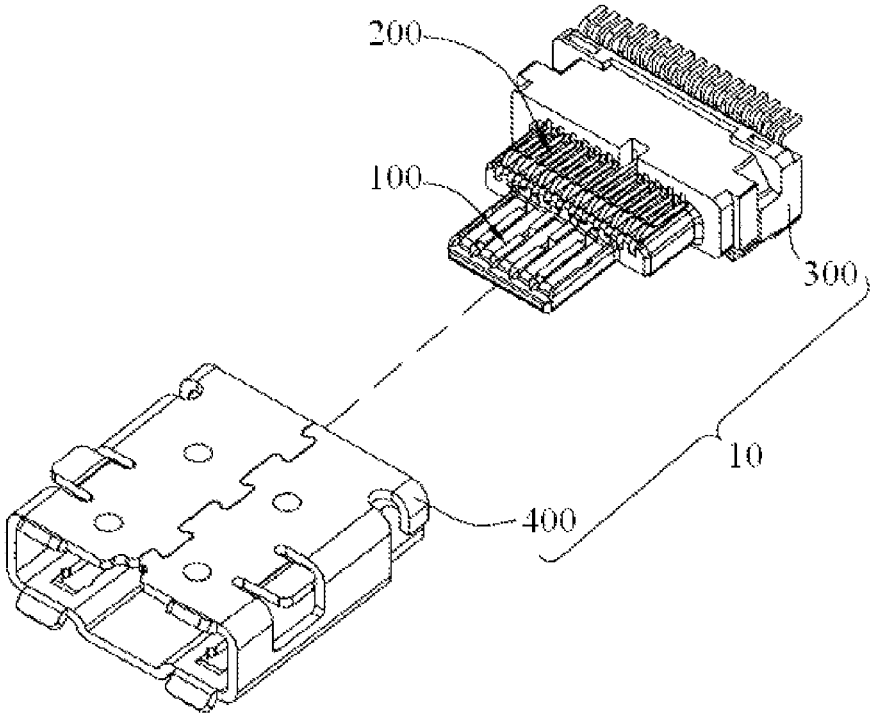
FIG. 2 is a perspective view showing a metal shield detached from the insulation body of the receptacle according to the invention.
Figure 3:
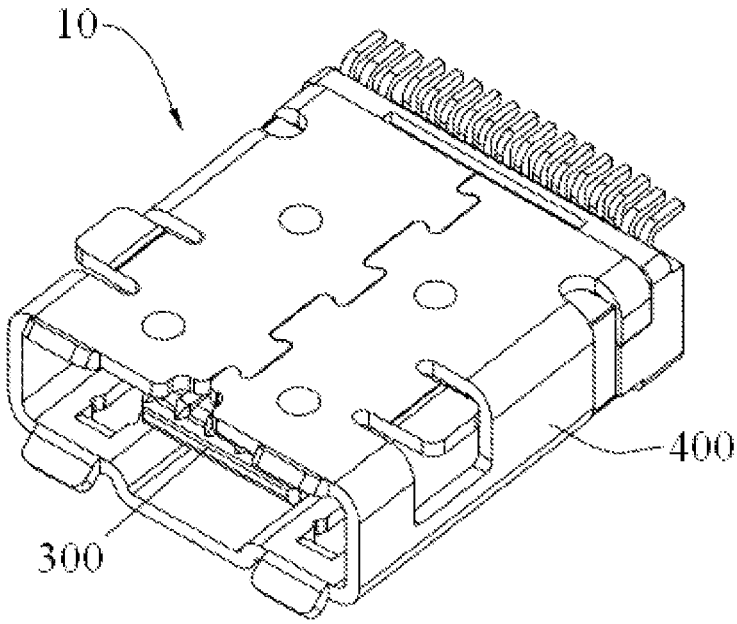
FIG. 3 is a perspective view of the metal shield.

As shown in FIGS. 1-3, a receptacle 10 includes an insulation body 300, a plurality of first contacts 100, a plurality of second contacts 200, and a metal shield 400. The plurality of first contacts 100 and the plurality of second contacts 200 are assembled in the insulation body 300. The insulation body 300 is received in the metal shield 400.

With reference to FIG. 1, the plurality of first contacts 100 may be a plurality of Micro-USB contacts consisting of five contacts for transmitting Micro-USB signals. In the exemplary embodiment shown in FIG. 1, the plurality of first contacts 100 has a plurality of first contact portions 101*a*, 102*a*, 103*a*, 104*a* and 105*a* at one side of the insulation body 300 and a plurality of first legs 101*b*, 102*b*, 103*b*, 104*b* and 105*b* along the other side of the insulation body 300.

Referring to FIG. 1 again, the plurality of second contacts 200 may be a plurality of I/O contacts consisting of twelve contacts for transmitting MHL signals. In the exemplary embodiment shown in FIG. 1, the plurality of second contacts 200 has a plurality of second contact portions 201*a*, 202*a*, 203*a*, 204*a*, 205*a*, 206*a*, 207*a*, 208*a*, 209*a*, 210*a*, 211*a* and 212*a* at the one side of the insulation body 300 and a plurality of second legs 201*b*, 202*b*, 203*b*, 204*b*, 205*b*, 206*b*, 207*b*, 208*b*, 209*b*, 210*b*, 211*b* and 212*b* along the other side of the insulation body 300.

As shown in FIG. 1, the plurality of first contact portions 101*a*, 102*a*, 103*a*, 104*a*, 105*a* are arranged in one row in a lateral direction of the insulation body 300. The plurality of second contact portions 201*a*, 202*a*, 203*a*, 204*a*, 205*a*, 206*a*, 207*a*, 208*a*, 209*a*, 210*a*, 211*a* and 212*a* are arranged in another row in the lateral direction of the insulation body 300.

The row of first contact portions 101*a*, 102*a*, 103*a*, 104*a* and 105*a* is spaced from the row of second contact portions 201*a*, 202*a*, 203*a*, 204*a*, 205*a*, 206*a*, 207*a*, 208*a*, 209*a*, 210*a*, 211*a* and 212*a* by a predetermined distance in a longitudinal direction of the insulation body 300. Please be noted that, for more clearly describing the receptacle 10, a length direction of the first and second contacts is defined as the longitudinal direction of the insulation body 300, and a width direction of the first and second contacts is defined as the lateral direction of the insulation body 300.

As shown in FIG. 1, the row of first contact portions 101*a*, 102*a*, 103*a*, 104*a* and 105*a* is located in front of the row of second contact portions 201*a*, 202*a*, 203*a*, 204*a*, 205*a*, 206*a*, 207*a*, 208*a*, 209*a*, 210*a*, 211*a* and 212*a*, along a longitudinal direction of the insulation body 300.

As shown in FIG. 1, the row of first contact portions 101*a*, 102*a*, 103*a*, 104*a* and 105*a* is spaced from the row of second contact portions 201*a*, 202*a*, 203*a*, 204*a*, 205*a*, 206*a*, 207*a*, 208*a*, 209*a*, 210*a*, 211*a* and 212*a* by a height with respect to a thickness of the insulation body 300. That is, the row of first contact portions and the row of second contact portions are positioned at two different height locations, respectively. However, the invention is not limited to this disclosure, and the row of first contact portions and the row of second contact portions may be positioned at a same height location in other embodiments according to the invention.

As shown in FIG. 1, the plurality of first legs 101*b*, 102*b*, 103*b*, 104*b* and 105*b* and the plurality of second legs 201*b*, 202*b*, 203*b*, 204*b*, 205*b*, 206*b*, 207*b*, 208*b*, 209*b*, 210*b*, 211*b* and 212*b* are arranged in one row along the other side of the insulation body 300. In this way, the plurality of first legs and the plurality of second legs may be easily soldered on a PCB (not shown) in a manner of SMT (Surface Mounted Technology).

Figure 6:
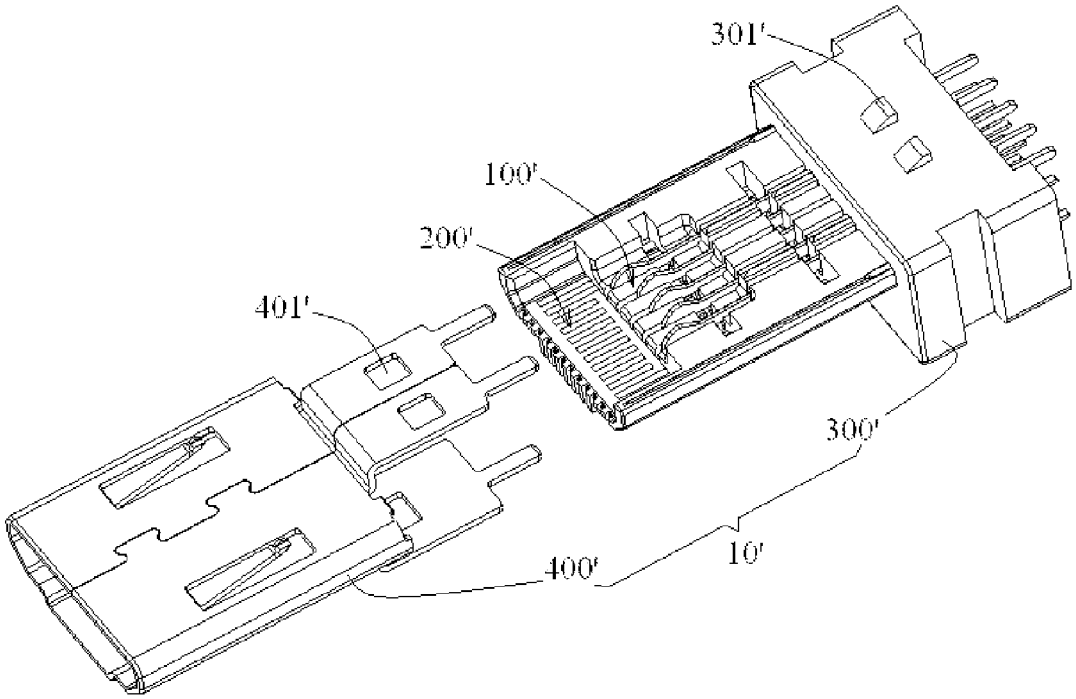
FIG. 6 is a perspective view of the plug with a metal shield detached from the insulation body.

As shown in FIG. 6, a plug 10' includes an insulation body 300', a plurality of first contacts 100', a plurality of second contacts 200', and a metal shield 400'. The plurality of first contacts 100' and the plurality of second contacts 200' are assembled in the insulation body 300'. The insulation body 300' is received in the metal shield 400'.

With reference to FIG. 6, the metal shield 400' may be assembled on the insulation body 300' in a snap-fit manner. For example, as shown in FIG. 6, the insulation body 300' is formed with protrusions 301' thereon, and the metal shield 400' is formed with slots 401' which mate with the protrusions 301'. In this way, the metal shield 400' and the insulation body 300' may be assembled together by the protrusions 301' and the slots 401' in the snap-fit manner.

Figure 4:
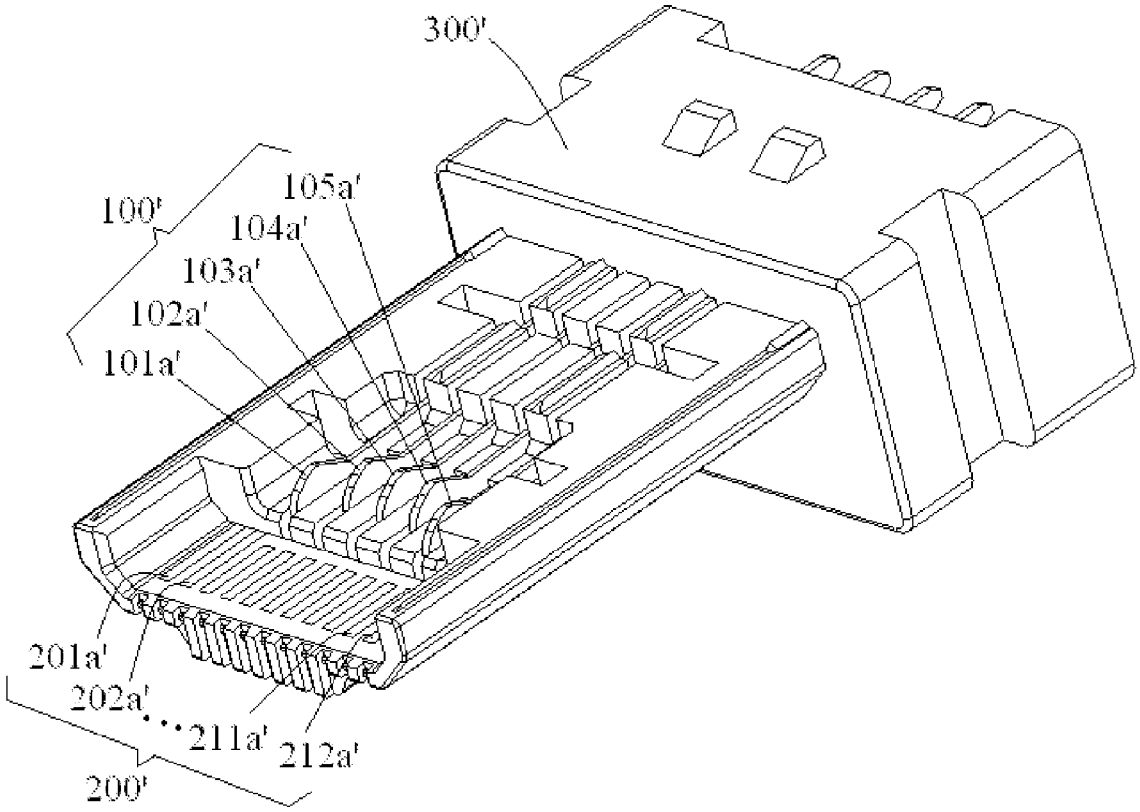
FIG. 4 is a perspective view of an insulation body of a plug according to the invention.
Figure 5:
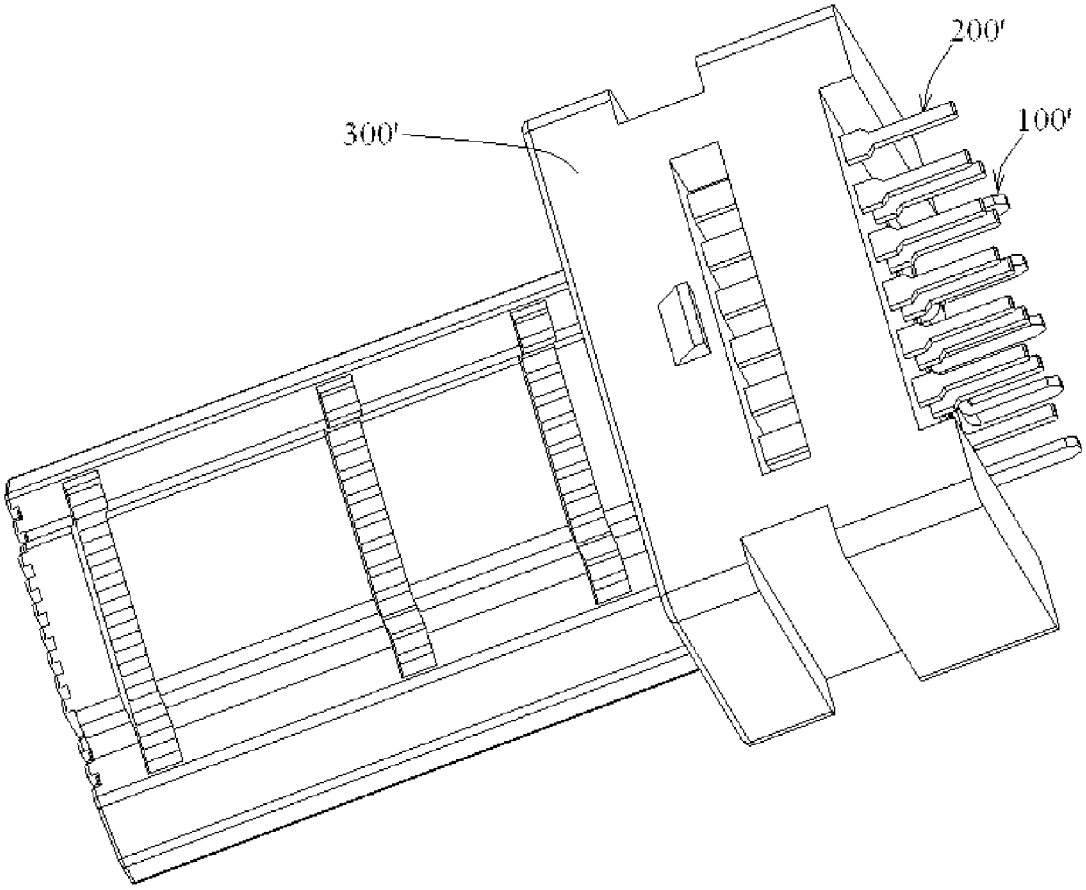
FIG. 5 is a bottom perspective view of the insulation body shown in FIG. 4.

As shown in FIGS. 4-5, the plurality of first contacts 100' may be a plurality of Micro-USB contacts consisting of five contacts for transmitting Micro-USB signals. In the exemplary embodiment shown in FIGS. 4-5, the plurality of first contacts 100' has a plurality of first contact portions 101*a*', 102*a*', 103*a*', 104*a*' and 105*a*' at one side of the insulation body 300'.

Figure 7:
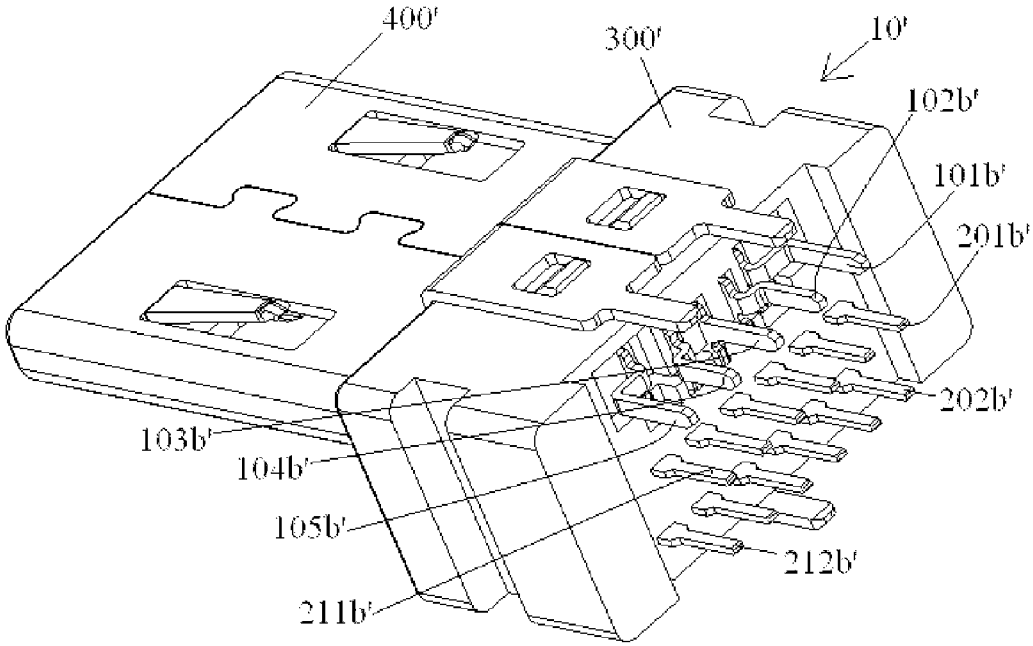
FIG. 7 is a perspective view of the plug after the metal shield has been assembled on the insulation body of the plug.
Figure 8:
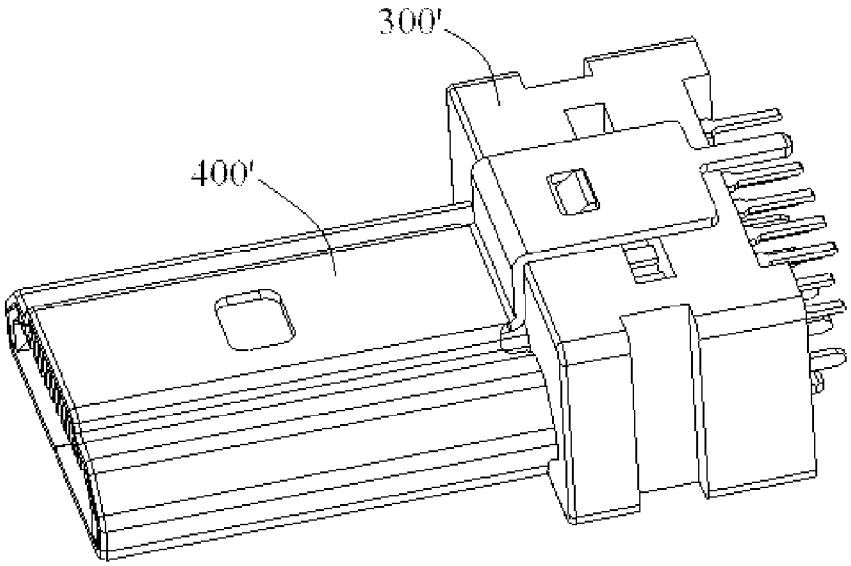
FIG. 8 is another perspective view of the plug and assembled metal shield as shown in FIG. 7.

As shown in FIGS. 7-8, in an exemplary embodiment, the plurality of first contacts 100' further has a plurality of first legs 101*b*', 102*b*', 103*b*', 104*b*' and 105*b*' along the other side of the insulation body 300'.

Referring back to FIGS. 4-5 again, the plurality of second contacts 200' may be a plurality of I/O contacts consisting of twelve contacts for transmitting MHL signals. In the exemplary embodiment shown in FIGS. 4-5, the plurality of second contacts 200' include a plurality of second contact portions 201*a*', 202*a*', 203*a*', 204*a*', 205*a*', 206*a*', 207*a*', 208*a*', 209*a*', 210*a*', 211*a*' and 212*a*' at the one side of the insulation body 300'.

As shown in FIGS. 7-8, the plurality of second contacts 200' further has a plurality of second legs 201*b*', 202*b*', 203*a*', 204*a*', 205*a*', 206*a*', 207*a*', 208*a*', 209*a*', 210*a*', 211*b*' and 212*b*' along the other side of the insulation body 300'.

Please refer to FIG. 4, in the exemplary embodiment, the plurality of first contact portions 101*a*', 102*a*', 103*a*', 104*a*' and 105*a*' are arranged in one row along a lateral direction of the insulation body 300'. The plurality of second contact portions 201*a*', 202*a*', 203*a*', 204*a*', 205*a*', 206*a*', 207*a*', 208*a*', 209*a*', 210*a*', 211*a*' and 212*a*' are arranged in another row along the lateral direction of the insulation body 300'.

As shown in FIG. 4, the row of first contact portions 101*a*', 102*a*', 103*a*', 104*a*' and 105*a*' is spaced from the row of second contact portions 201*a*', 202*a*', 203*a*', 204*a*', 205*a*', 206*a*', 207*a*', 208*a*', 209*a*', 210*a*', 211*a*' and 212*a*' by a predetermined distance along a longitudinal direction of the insulation body 300'. Please be noted that, for more clearly describing the plug 10' of the present invention, a length direction of the first and second contacts 100', 200' is defined as the longitudinal direction of the insulation body 300', and a width direction of the first and second contacts 100', 200' is defined as the lateral direction of the insulation body 300'.

As shown in the exemplary embodiment of FIG. 4, the row of first contact portions 101*a*', 102*a*', 103*a*', 104*a*' and 105*a*' is located behind the row of second contact portions 201*a*', 202*a*', 203*a*', 204*a*', 205*a*', 206*a*', 207*a*', 208*a*', 209*a*', 210*a*', 211*a*' and 212*a*', with respect to the longitudinal direction of the insulation body 300'.

In an exemplary embodiment, as shown in FIG. 4, the row of first contact portions 101*a*', 102*a*', 103*a*', 104*a*' and 105*a*' is spaced from the row of second contact portions 201*a*', 202*a*', 203*a*', 204*a*', 205*a*', 206*a*', 207*a*', 208*a*', 209*a*', 210*a*', 211*a*', 212*a*' by a height with respect to a thickness of the insulation body 300'. That is, the row of first contact portions and the row of second contact portions are positioned at two different height locations, respectively. But, the invention is not limited to the shown disclosure. Rather, the row of first contact portions and the row of second contact portions may be positioned at a same height location.

As shown in FIG. 7, the plurality of first legs 101*b*', 102*b*', 103*b*', 104*b*' and 105*b*' are arranged in one row in the lateral direction of the insulation body 300'. The plurality of second legs 201*b*', 202*b*', 203*b*', 204*b*', 205*b*', 206*b*', 207*b*', 208*b*', 209*b*', 210*b*', 211*b*' and 212*b*' are arranged in two rows in the lateral direction of the insulation body 300'. The one row of first legs and the two rows of second legs are spaced from each other by a height with respect to a thickness of the insulation body 300'. That is, the one row of first legs and the two rows of second legs are positioned at three different height locations, respectively.

In the shown embodiment in FIGS. 4 through 8, the plug 10' may be mated with the receptacle 10 shown in FIGS. 1-3 to form a connector assembly.

Although not shown, when the plug 10' is inserted into the receptacle 10, the plurality of first contact portions 101*a*', 102*a*', 103*a*', 104*a*' and 105*a*' and the plurality of second contact portions 201*a*', 202*a*', 203*a*', 204*a*', 205*a*', 206*a*', 207*a*', 208*a*', 209*a*', 210*a*', 211*a*', 212*a*' of the plug 10' electrically contact with the plurality of first contact portions 101*a*, 102*a*, 103*a*, 104*a* and 105*a* and a plurality of second contact portions 201*a*, 202*a*, 203*a*, 204*a*, 205*a*, 206*a*, 207*a*, 208*a*, 209*a*, 210*a*, 211*a* and 212*a* of the receptacle 10, respectively.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector assembly, comprising:

a receptacle having;

a receptacle insulation body;

a plurality of first receptacle contacts assembled in the receptacle insulation body and having a plurality of first receptacle contact portions disposed at a first side of the receptacle insulation body and a plurality of first receptacle legs disposed along a second side of the receptacle insulation body, the plurality of first receptacle contact portions arranged in a first receptacle row along a surface side of the first side; and a plurality of second receptacle contacts assembled in the receptacle insulation body and having a plurality of second receptacle contact portions disposed at the first side of the receptacle insulation body between the plurality of first receptacle contact portions and the plurality of first receptacle legs and a plurality of second receptacle legs disposed along the second side of the receptacle insulation body between the plurality of first receptacle legs, the plurality of second receptacle contact portions arranged along a second receptacle row along the surface side of the first side such that the first receptacle row is spaced from the second receptacle row by a predetermined distance along a longitudinal axis of the receptacle insulation body; and a plug, having:

a plug insulation body;

a plurality of first plug contacts assembled in the plug insulation body and having a plurality of first plug contact portions disposed at a first side of the plug insulation body and a plurality of first plug legs disposed along a second side of the plug insulation body, the plurality of first plug contact portions arranged in a first plug row along a surface side of the first side; and a plurality of second plug contacts assembled in the plug insulation body and having a plurality of second plug contact portions disposed at the first side of the plug insulation body and a plurality of second plug legs disposed along the second side of the plug insulation body, the plurality of second plug contact portions arranged along a second plug row along the surface side of the first side such that the first plug row is spaced from the second plug row by a predetermined distance along a longitudinal axis of the plug insulation body.

2. The connector assembly according to claim 1, wherein the plurality of first receptacle legs and the plurality of second receptacle legs are arranged along a third receptacle row along the second side of the receptacle insulation body.

3. The connector assembly according to claim 2, wherein the first plug row is spaced from the second plug row by a height with respect to a thickness of insulation body.

4. The connector assembly according to claim 3, wherein the plurality of first plug legs are arranged along a third plug row along the second side of the plug insulation body.

5. A plug, comprising:

an insulation body;

a plurality of first contacts assembled in the insulation body and having a plurality of first contact portions disposed at a first side of the insulation body and a plurality of first legs disposed along a second side of the insulation body, the plurality of first contact portions arranged in a first row along a surface side of the first side; and a plurality of second contacts assembled in the insulation body and having a plurality of second contact portions disposed at the first side of the insulation body and a plurality of second legs disposed along the second side of the insulation body, the plurality of second contact portions arranged along a second row along the surface side of the first side such that the first row is spaced from the second row by a predetermined distance along a longitudinal axis of the insulation body;

wherein the plurality of first legs are arranged along a third row along the second side and the plurality of second legs are arranged along a plurality of fourth rows along the second side.

6. A plug, comprising:

an insulation body;

a plurality of first contacts assembled in the insulation body and having a plurality of Micro USB contacts consisting of five contacts with each having a plurality of first contact portions disposed at a first side of the insulation body and a plurality of first legs disposed along a second side of the insulation body, the plurality of first contact portions arranged in a first row along a surface side of the first side; and a plurality of second contacts assembled in the insulation body and having a plurality of I/O contacts consisting of twelve contacts with each having a plurality of second contact portions disposed at the first side of the insulation body and a plurality of second legs disposed along the second side of the insulation body, the plurality of second contact portions arranged along a second row along the surface side of the first side such that the first row is spaced from the second row by a predetermined distance along a longitudinal axis of the insulation body.

7. A plug, comprising:

an insulation body;

a plurality of first contacts assembled in the insulation body and having a plurality of first contact portions disposed at a first side of the insulation body and a plurality of first legs disposed along a second side of the insulation body, the plurality of first contact portions arranged in a first row along a surface side of the first side; and a plurality of second contacts assembled in the insulation body and having a plurality of I/O contacts consisting of twelve contacts with each having a plurality of second contact portions disposed at the first side of the insulation body and a plurality of second legs disposed along the second side of the insulation body, the plurality of second contact portions arranged along a second row along the surface side of the first side such that the first row is spaced from the second row by a predetermined distance along a longitudinal axis of the insulation body.

8. A receptacle, comprising:

an insulation body;

five Micro USB first contacts assembled in the insulation body, each first contact having a first contact portion disposed at a first side of the insulation body and a first leg disposed along a second side of the insulation body, the first contact portions arranged in a first row along a surface side of the first side; and a plurality of second contacts assembled in the insulation body and having a plurality of second contact portions disposed at the first side of the insulation body between the plurality of first contact portions and the plurality of first legs and a plurality of second legs disposed along the second side of the insulation body between the plurality of first legs, the plurality of second contact portions arranged along a second row along the surface side of the first side such that the first row is spaced from the second row by a predetermined distance along a vertical axis of the insulation body.

9. The receptacle according to claim 8, wherein the plurality of second contacts is a plurality of I/O contacts consisting of twelve contacts.

10. A receptacle, comprising:

an insulation body;

a plurality of first contacts assembled in the insulation body and having a plurality of first contact portions disposed at a first side of the insulation body and a plurality of first legs disposed along a second side of the insulation body, the plurality of first contact portions arranged in a first row along a surface side of the first side; and twelve I/O second contacts assembled in the insulation body, each second contact having a second contact portion disposed at the first side of the insulation body between the plurality of first contact portions and the plurality of first legs and a second leg disposed along the second side of the insulation body between the plurality of first legs, the second contact portions arranged along a second row along the surface side of the first side such that the first row is spaced from the second row by a predetermined distance along a vertical axis of the insulation body.

* * * * *